US005711201A

United States Patent [19]

Thompson

[11] Patent Number: 5,711,201

[45] Date of Patent: Jan. 27, 1998

[54] BOTTLE TOP CUTTING DEVICE

[76] Inventor: Pamela J. Thompson, 8516 Huron River Dr., White Lakes, Mich. 48386

[21] Appl. No.: 582,209

[22] Filed: Jan. 2, 1996

[51] Int. Cl.[6] ..... B26D 1/01

[52] U.S. Cl. ..... 83/856; 83/946; 30/278; 30/286; 30/296.1

[58] Field of Search ..... 83/946, 856, 167, 83/931; 30/1.5, 279.6, 278, 296.1, 286, 281, 109, 111, 400; 225/93

[56] References Cited

U.S. PATENT DOCUMENTS

| | | | |
|---|---|---|---|
| 485,234 | 11/1892 | Smith | 30/109 |
| 1,094,338 | 4/1914 | Leisegang . | |
| 2,142,695 | 1/1939 | Mainzer | 30/1.5 |
| 2,691,820 | 10/1954 | Hislop | 30/1.5 |
| 2,726,448 | 12/1955 | Smith | 30/286 |
| 3,508,692 | 4/1970 | Hloten . | |
| 3,635,473 | 1/1972 | Sasaki et al. . | |
| 3,757,622 | 9/1973 | Berry | 83/165 |
| 3,910,144 | 10/1975 | Hess | 83/946 |
| 4,250,601 | 2/1981 | Ward . | |
| 4,405,067 | 9/1983 | Caron | 225/93 |
| 4,637,139 | 1/1987 | Chen | 30/1.5 |
| 5,097,733 | 3/1992 | Benkoski | 83/856 |
| 5,125,333 | 6/1992 | Gourley, III | 83/946 |

*Primary Examiner*—Maurina T. Rachuba
*Attorney, Agent, or Firm*—Weintraub, DuRoss & Brady

[57] ABSTRACT

The present invention is directed to a bottle top cutting device which includes a base and a housing. The housing has an aperture formed therein, the aperture configured to allow the passage of a bottle tip thereinto while precluding insertion of a finger. A razor is housed in the housing and is positioned such that as the bottle tip is slid in the aperture towards the razor, the tip is cut off of the bottle.

6 Claims, 5 Drawing Sheets

FIG 1
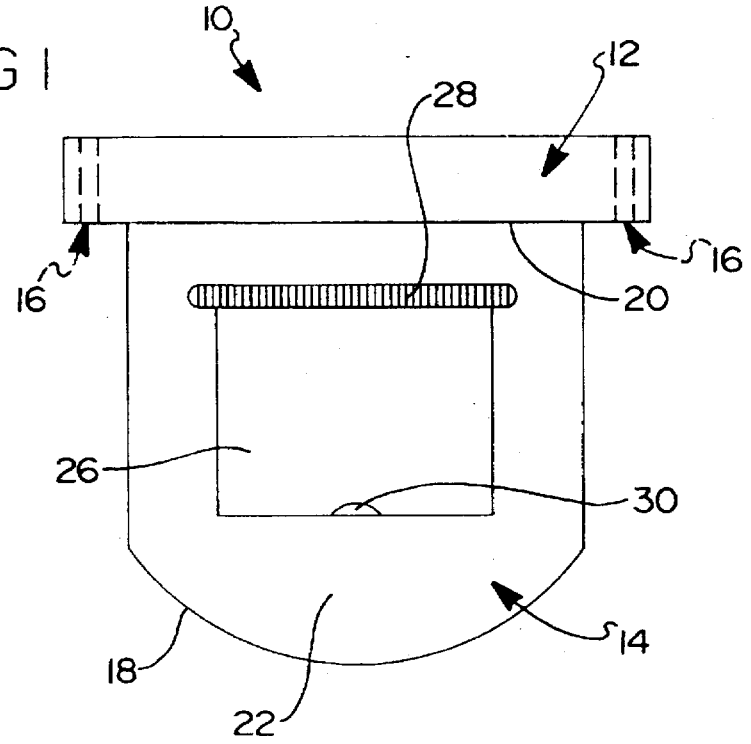
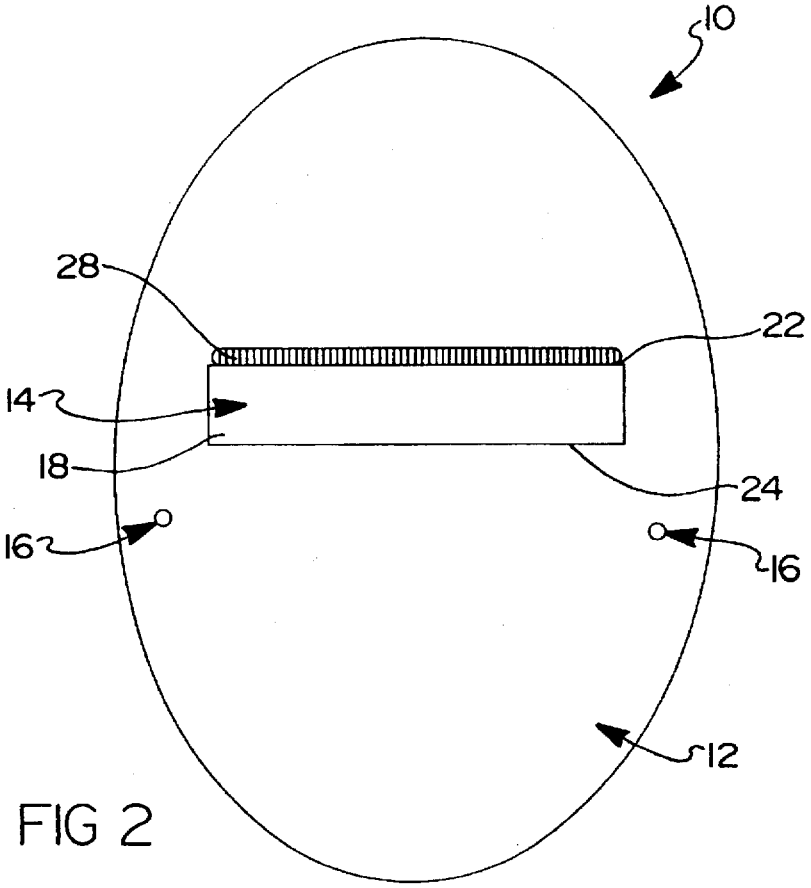
FIG 2

FIG 3
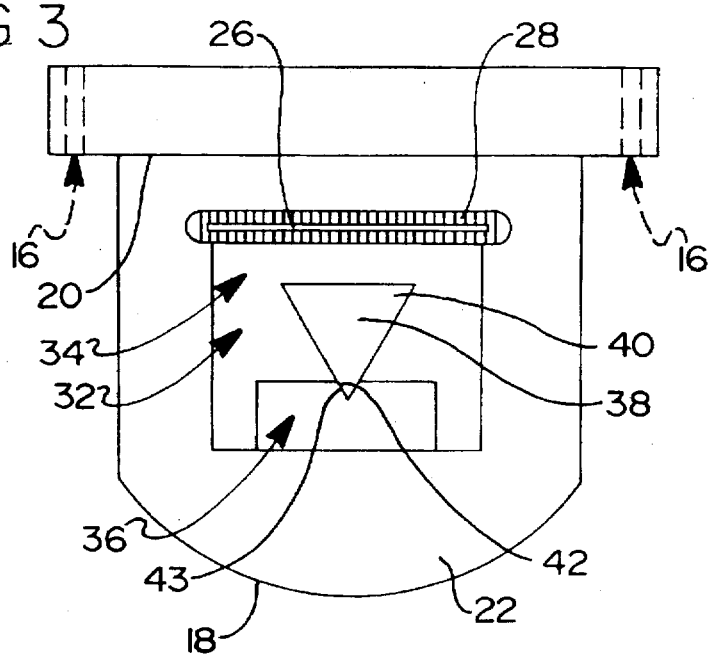
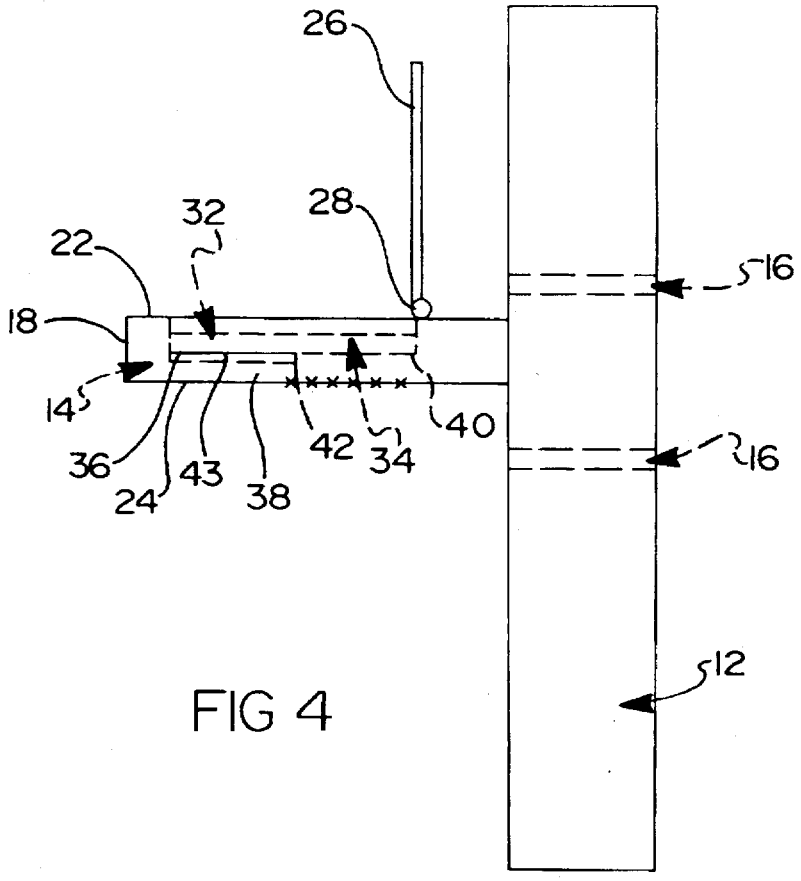
FIG 4

FIG 5
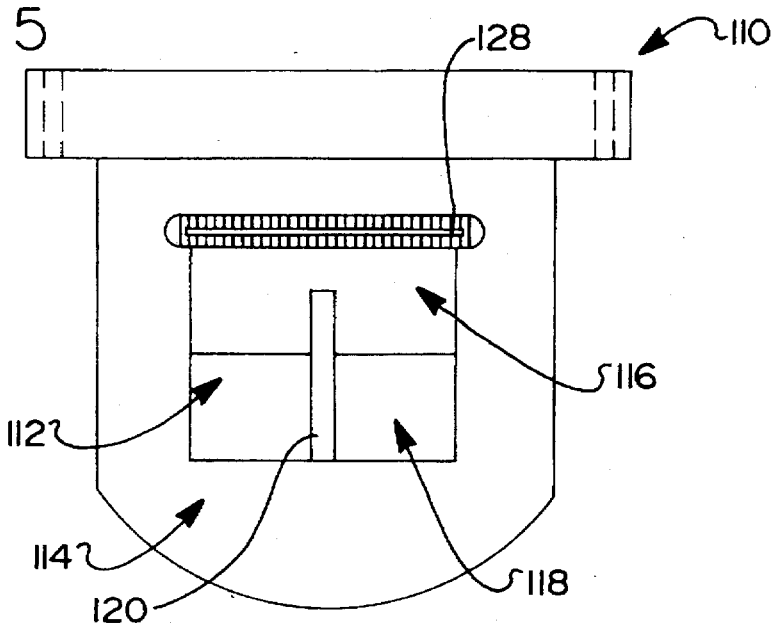
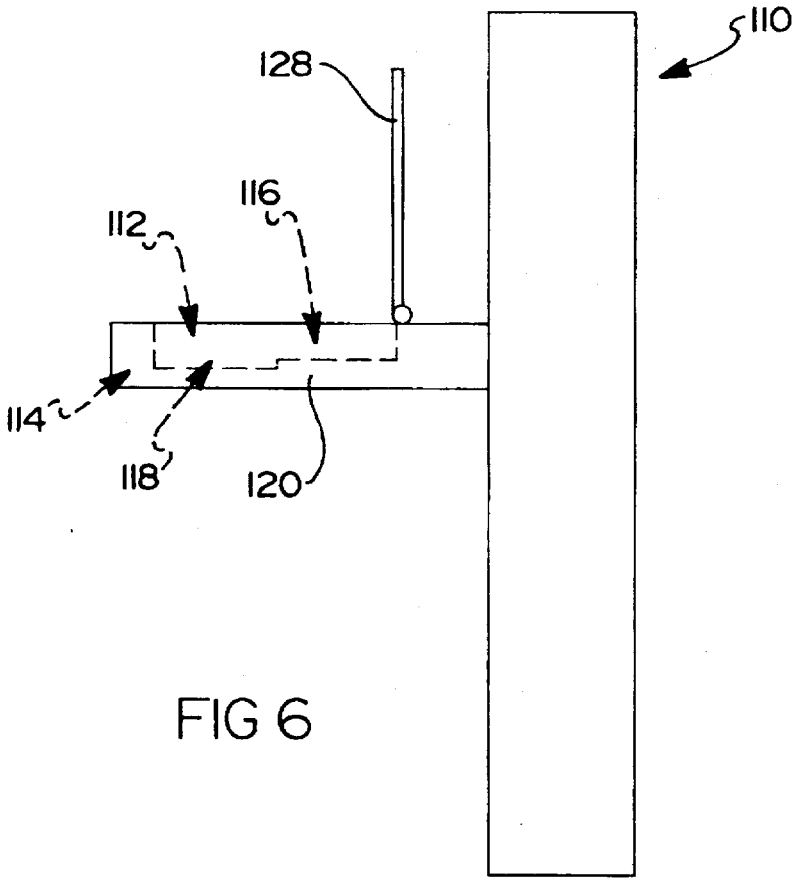
FIG 6

FIG 7
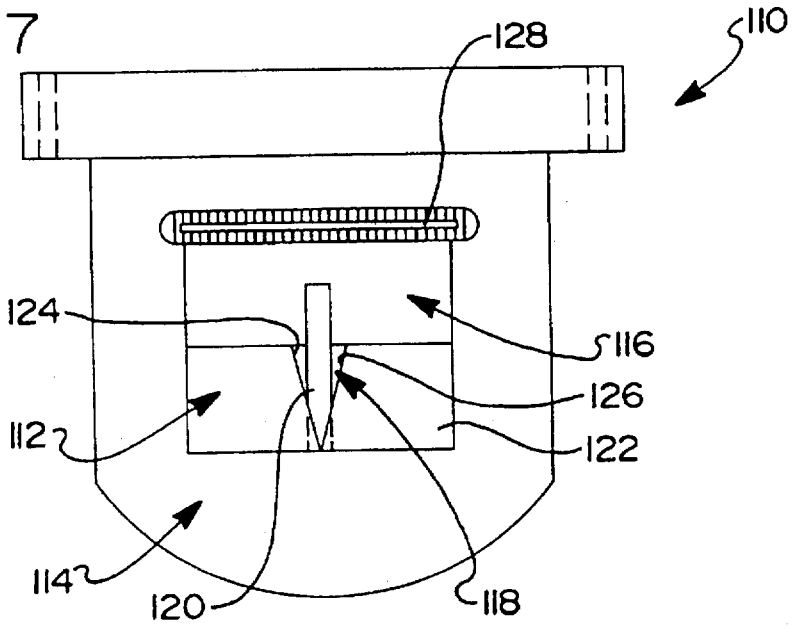
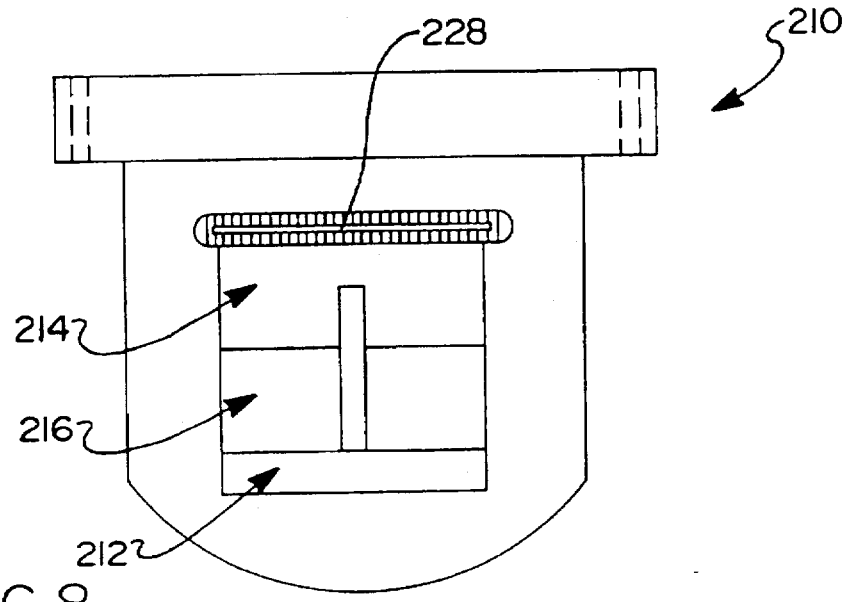
FIG 8

FIG 9
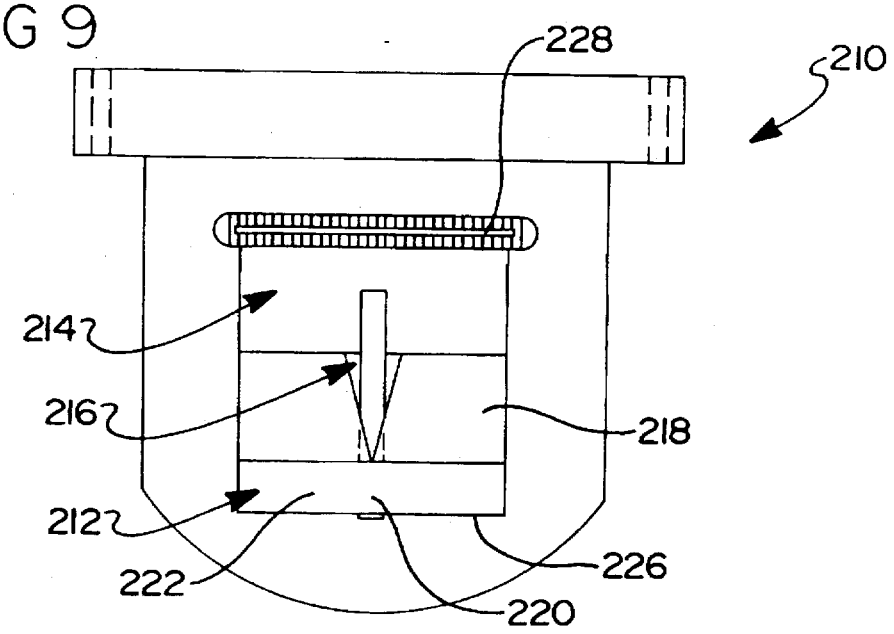
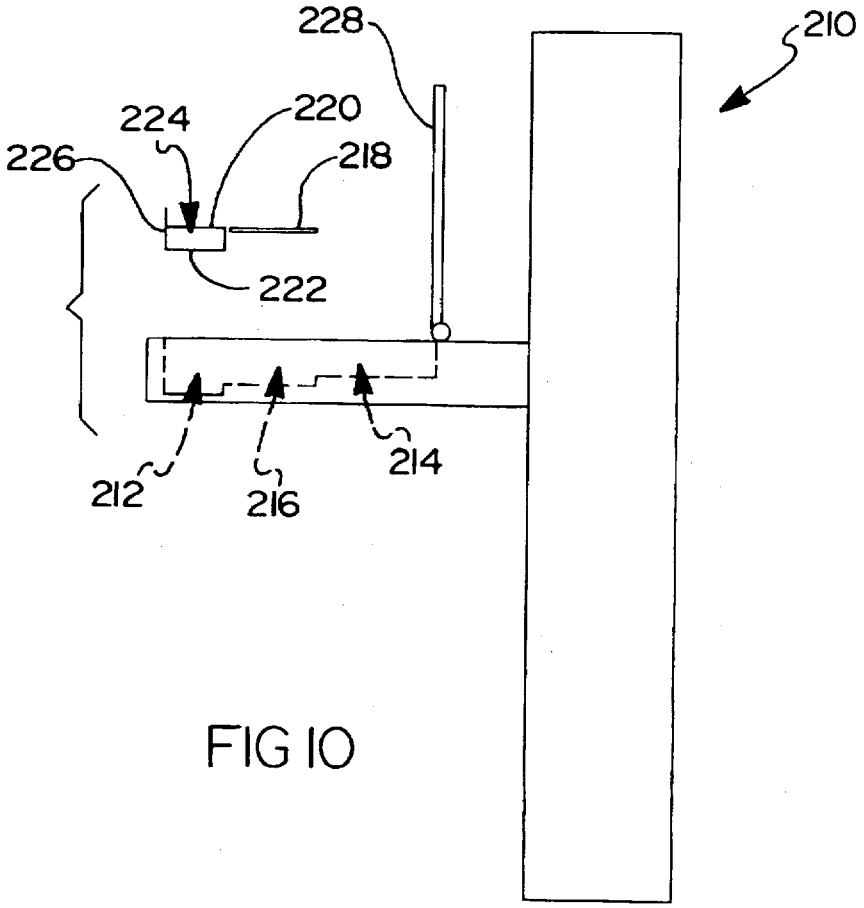
FIG 10

BOTTLE TOP CUTTING DEVICE

BACKGROUND OF THE INVENTION

I. Field of the Invention

The present invention relates generally to bottle openers. More particularly, the present invention provides a bottle opener with a replaceable cutting blade. Even more particularly, the present invention provides a safety bottle opener which may be mounted to a surface.

II. Description of the Prior Art

Beauty salons provide many different services to a clientele including, but not limited to, hair-cuts, hair stylings, hair colorings, and permanents. Permanent, or perming someone's hair, essentially consists of coating the hair with a chemical mixture, such that curl, or body is added to the hair.

The chemicals used in permanent solutions tend to be extremely toxic and caustic and as such, bottles containing permanent solutions have a cap that must be cut off at its top in order to access and utilize the solution. This ensures that the solution is not tampered with, nor accidentally spilled on a person which may cause severe burns or other injuries if it comes in contact with the skin or eyes.

It is well known in the industry to which the present invention pertains to use shears to snip the top off a permanent solution bottle. Permanent solution tends to thereby spill onto the blade of the shears which, over time, corrode because of the solution which remains thereupon. The shears, thus, become dull and unusable.

An alternative approach which has been employed in many salons is to use free standing razor blades to slice the top off a permanent solution bottle. Over time, the razor blades become coated with the permanent solution and thus corrode, i.e. rust. It must be appreciated that if a user cuts themselves on a rusted razor coated with permanent solution, they may potentially suffer serious injury. At the very least, the user will have a wound with a quantity of permanent solution disposed therein.

Thus, the art in this field is deficient in that there is no known device which provides a means for safely cutting the top off a permanent bottle. Additionally, there is no neat way to store the blades necessary to cut the tops off permanent solution bottles.

It is to the solution of these problems to which the present invention is directed.

SUMMARY OF THE INVENTION

The present invention provides a bottle top cutting device, the device comprising:

a base configured to be mounted to a surface;

a housing mounted to the base and projecting therefrom, the housing having an interior, the housing comprising:

(a) a top wall, the top wall having a first aperture formed therein, the aperture providing access to the interior of the housing;

(b) a bottom wall opposite the top wall, the bottom wall having a second aperture formed therein, the aperture providing access to the interior of the housing, the aperture being sufficiently large to emplace place a top of a bottle in the aperture;

(c) a plurality of sidewalls extending between the top wall and the bottom wall;

(d) a first recess formed in the interior and disposed intermediate the top wall and the bottom wall, such that the aperture in the top wall of the housing provides access to the first recess;

(e) a second recess disposed intermediate the first recess and the bottom wall, the second recess comprising a seat for a razor blade; and (f) a razor blade, the razor blade having a cutting edge, the razor blade being seated in the second recess, the cutting edge traversing the second aperture, and wherein the second recess is in registry with the aperture formed in the bottom wall, and further wherein the razor blade seat is disposed at a first end of the aperture.

The bottle top cutting device of the present invention includes a base. The base is intended to be mounted to a surface and, as such, is provided with a plurality of apertures formed therethrough. The apertures allow screws, or the like to pass therethrough to mount the base to a surface such as a wall, counter, or the like.

A housing is mounted to the base, generally at a substantially right angle thereto. The housing has a first recess formed therein. The recess is configured to receive a cover which is mounted to the housing such that the cover may be lifted off the housing, or rotated to a substantially vertical orientation so that it is not resting thereupon. The first recess is formed therein to slidably receive the cover when it is not in a substantially vertical orientation.

A second recess, formed within and extending downwardly from the first recess, is configured to provide a seat for a razor blade. It is to be appreciated that several differently configured razor blades may be used with the present invention.

The bottom surface of the housing includes an aperture formed therethrough. The aperture may be configured in several different ways, each of which will be discussed hereinbelow in the detailed description of the preferred embodiment of the present invention.

In use, a permanent solution bottle top is placed through the aperture and pulled laterally toward the user. As the bottle top is moved laterally it engages the razor blade which is seated in the second recess such that the blade contacts and cuts the top off of the permanent solution bottle. In this fashion, the bottle top is removed from the bottle without exposing the user to the solution or to the sharp edge of the razor blade.

It is to be additionally appreciated that the present invention may include a receptacle seated in a third recess. The third recess is disposed adjacent to the second recess and within the first recess. The receptacle is configured to receive that portion of the bottle top that has been cut off. A user may therefore, periodically, remove the receptacle, empty its contents into the trash without contacting the bottle tops and then replace the receptacle in the third recess.

For a more complete understanding of the present invention reference is made to the following detailed description and accompanying drawings. In the drawings, like reference characters refer to like parts throughout the several views, in which:

DESCRIPTION OF THE DRAWINGS

FIG. 1 is a top plan view of a bottle top cutting device in accordance with the present invention, the cover of the device in a closed position;

FIG. 2 is a front plan view of the bottle top cutting device of FIG. 1;

FIG. 3 is a top plan view of a bottle top cutting device in accordance with the present invention having the cover in an open position;

FIG. 4 is a side cross-sectional view of the bottle top cutting device of FIG. 3 taken along 4—4;

FIG. 5 is a top plan view of a second embodiment of the bottle top cutting device in accordance with the present invention;

FIG. 6 is a side cross-sectional view of the bottle top cutting device of FIG. 5 taken along 6—6;

FIG. 7 is a top plan view of the bottle top cutting device of FIG. 5 with a razor placed therein;

FIG. 8 is a top plan view of a third embodiment of the bottle top cutting device in accordance with the present invention;

FIG. 9 is a top plan view of the bottle top cutting device of FIG. 8 with the catch and razor in place therein; and FIG. 10 is a side cross-sectional exploded view of the bottle top cutting device depicted in FIG. 9 taken along 10—10.

DETAILED DESCRIPTION OF THE PREFERRED EMBODIMENTS

FIGS. 1 and 2 depict a preferred embodiment of the bottle top cutting device 10 in accordance with the present invention. The device 10 generally includes a base 12, and a housing 14. The base 12 is preferably formed from wood, or some other durable material which will resist corrosion if exposed to permanent solution. Other materials which the base 12 may be formed from include plastic, glass, or the like.

The base 12 has a plurality of apertures 16 formed therein. The plurality of apertures 16 are provided so that the base may be mounted to a surface via screws, rivets or other means for mounting well-known to the skilled artisan. The plurality of apertures 16 may be threaded to provide additional stability if the device 10 is mounted to a wall or other similar surface via screws. It is to be appreciated that although the preferred means for mounting the base 12 and, thus, the device 10, to a surface is screws, rivets, or the like, it is also possible to mount the base 12 to a surface via glue, two-sided tape or any other well-known means for mounting.

The base 12 is preferably oval in its configuration, and this arrangement for the base 12 is included in each of the embodiments disclosed herein. Although the base 12 may be of any shape, it is advantageous to utilize an oval shape, as the oval shape provides additional stability to the device 10. More particularly, because an oval has two axes, where one axis is greater than the other, additional stability is provided in the plane of the longer axis. In this fashion, the device 10 is more securely attached to a surface than if the base 12 had a circular, or square configuration.

The housing 14 comprises a front wall 18, a back wall 20, a top wall 22 and a bottom wall 24 defining an interior 32. Additionally, the housing 14 is, preferably, formed from the same material as the base 12. It is to be appreciated, however, that the housing 14 may be formed from some other durable material such as one of those set out hereinabove with respect to the base 12.

The back wall 20 of the housing 14 is mounted to the base 12 via screws, nails, glue, rivets, brackets or any other means for mounting that is well-known to the skilled artisan. The housing 14, preferably, is mounted normal to the base 12; however, it may be mounted at an inclined or declined angle as well.

The housing 14 additionally includes a cover 26 which is mounted to the top surface 22 thereof. In the preferred embodiments, the cover 26 is mounted to the top surface 22 of the housing 14 via a hinge 28. This hinge 28 is, preferably, a spring biased hinge which urges the cover 26 to maintain contact with the housing 14. This helps protect children who may have an interest in opening the cover 26. It is to be appreciated that the housing 14 is configured such that when the cover 26 is down, i.e. the housing is closed, the cover 26 is flush with the top surface 22 of the housing 14.

A small notch 30 is formed in the cover 26. If a user wishes to access the interior of the housing, the reasons for which will become clear with a further description of the functioning of the present device, they may use a small object, such as a coin, to lift the cover 26 against the biasing force of the hinge 28. Although a spring biased hinge is preferred, other means for mounting the cover 26 to the top surface 22 of the housing 14 may be used. Alternatively, the cover 26 may rest upon the top surface 22 of the housing 14.

In FIGS. 3 and 4, there is depicted a preferred, first embodiment of the device 10 of the present invention where the cover 14 is in a substantially upright orientation, thus exposing the interior 32 of the housing 14. The interior 32 includes a first recess 34 which is configured substantially identically to the cover 26. In this fashion when the cover 26 is down, it seats in the first recess 34 and is flush with the top surface 22 of the housing 14.

Although the first recess 34 is depicted as substantially square, it must be appreciated that the purpose of the cover is served as long as the cover 26 and the first recess 34 have a substantially similar configuration, i.e. the cover 26 may slidably and snugly seat in the first recess 34. Thus, small children will be prevented from opening the housing 14 of the device 10.

The interior 32 of the housing additionally includes a second recess 36. The second recess 36 lies within the boundaries of the first recess 34 and is provided therein to seat a razor or some other well-known thin cutting device. The blade of the razor is intended to face the back wall 20 of the housing 14. The reasons for this will be more clear upon an explanation of the functioning of the device 10 of the present invention.

A tapered aperture 38 is provided in the housing and extends through the housing between the top surface 22 to the bottom surface 24 thereof. The aperture 38 tapers from a wide end 40 to a narrow end 42, where the narrow end 42 is in communication with the second recess 36. More particularly, a razor blade 43 which is snugly seated in the second recess 36 overlays the narrow end 42 of the aperture 38.

It must be appreciated that the aperture 38 is intended to receive the top of a permanent solution bottle, or some other bottle that includes a top which must be cut off in order to access and utilize the contents therein. As such, the aperture 38 may be especially small. At least small enough to preclude the insertion of a finger or the like, thus protecting unwary persons from injuring themselves on the device 10.

In use, the cover 26 of the device 10 is in the down position, precluding access to the interior 34 of the housing 14. A user inserts the tip of a bottle into the aperture 38 and slides the bottle tip towards the front wall 24 of the housing 14. Thus, the bottle top engages the razor blade 43 seated in the second recess 36 and is thereby cut off. The second recess 36 is deep enough to allow the bottle top to rest in the space between the top of the razor blade 43 and the cover 26 which seats against the interior 34 of the housing 14 at the first recess 34. The cover 26 does not contact the razor blade.

When the device is filled with bottle tops, a user may lift the cover 26 with a screw driver, coin, or some other well-known implement which will serve such a purpose. At that time, the bottle tops may be removed and if the razor blade 43 is dull or corroded, it may be removed and replaced with a fresh blade. The cover 26 may then be released and will then seat itself in the first recess 34, flush with the top surface 22 of the device 10.

A second embodiment of the bottle top cutting device of the present invention is depicted in FIGS. 5–7, generally at 110. The device 110 is substantially identical to the first embodiment except for the interior 112 of the housing 114. Therefore, the components which are identical to those of the first embodiment will not be discussed further herein.

The interior 112 of the housing 114 of the device 110 includes a first recess 116 and a second, deeper recess 118. The interior additionally includes an aperture 120 extending between the bottom surface of the housing and the top surface thereof. In this instance, however, the aperture is rectangular in its configuration, as opposed to triangular as in the first embodiment.

A dual faced razor blade 122 having opposedly arranged edges 124, 126 seats in the second recess 118. A bottle top is placed into the aperture and slid toward the razor 122. Once again, the cover 128 of the device 110 should be in the down position when the device is being used.

As the top of the bottle is slid towards the edges of the blade, each face 124, 126 engages the bottle top, cutting it off the bottle. The use of the dual faced razor is advantageous because it contacts the tip at two locations, thusly easing the process of cutting the top off the bottle. Such razors may be produced by those skilled in the art.

Each of the other components of the device 110 are substantially identical to those disclosed with regard to the first embodiment hereof.

A third embodiment of the present invention is shown in FIGS. 8–10, generally at 210. The third embodiment is substantially identical to the second embodiment, and as such, only those components which are unique to the third embodiment will be discussed hereinbelow. It is to be appreciated that all the other components have been taught and disclosed hereinabove with regards to the first and second embodiments.

The device 210 includes a third recess 212 which is deeper than the first recess 214 and the second recess 216. A dual faced razor 218 seats in the second recess. The dual faced razor 218 performs the same function as the dual faced razor 122 of the second embodiment.

A receptacle 220 seats in the third recess 212. The receptacle is generally an open topped housing having a bottom surface 222 and a plurality of side walls 224 extending upwardly therefrom. One side wall 226 extends upwardly more so than the other side walls. The receptacle is preferably formed from one of the materials disclosed hereinabove with respect to the device in general. More specifically, the receptacle may be formed from wood, galvanized metal, plastic, or some other durable, corrosion resistant material.

When in use, a user places the bottle top into the aperture by inserting the bottle top up into the aperture from underneath the device 210. As the bottle top is slid towards the dual faces of the razor blade, the tip is cut from the bottle. In this embodiment of the device 210, however, the bottle top falls into the receptacle 220. When the receptacle 220 is full, a user lifts the cover 228, grasps the elongated side wall 226, lifts the receptacle 220 from the third recess 212, and empties its contents into a waste receptacle. In this fashion, a user does not have to touch any of the bottle tops, which may be coated with permanent solution.

Alternatively, the third recess may be formed as an aperture passing through the bottom of the housing. As such, the receptacle 220 is not included therein and the bottle tops that are cut off the bottles will fall out of the cutter 210 and fall to the floor.

As is evident from the foregoing detailed description of the preferred embodiments of the present invention, the bottle top cutting device presents many advantages over the devices and methods utilized in the past. The bottle top cutting device is cleaner, and safer to use. Additionally, using the device ensures that razor blades will not be left lying about, and that shears will not be ruined.

As will be realized, the invention is capable of other and different embodiments and its several details are capable of modifications in various obvious respects, all without departing from the invention.

Having, thus, described the present invention, what is claimed is:

1. A bottle top cutting device, the device comprising:

a base configured to be mounted to a surface;

a housing mounted to the base and projecting therefrom, the housing having an interior, the housing comprising:

(a) a top wall, the top wall having a first aperture formed therein, the aperture providing access to the interior of the housing;

(b) a bottom wall opposite the top wall, the bottom wall having a second aperture formed therein, the aperture providing access to the interior of the housing, the aperture being sufficiently large to emplace a top of a bottle in the aperture and being slidable therein;

(c) a plurality of sidewalls extending between the top wall and the bottom wall;

(d) a first recess formed in the interior and disposed intermediate the top wall and the bottom wall, such that the aperture in the top wall of the housing provides access to the first recess;

(e) a second recess formed in the interior and disposed intermediate the first recess and the bottom wall, the second recess comprising a seat for a razor blade; and (f) a razor blade, the razor blade having a cutting edge, the razor blade being seated in the second recess, the cutting edge traversing the second aperture, and wherein the second recess is in registry with the aperture formed in the bottom wall, and further wherein a bottle top is engageable with the cutting edge to sever the top from the bottle.

2. The bottle top cutting device of claim 1, further comprising a cover.

3. The bottle top cutting device of claim 2 further comprising a hinge disposed on the top wall adjacent to the first aperture, the cover being attached to the hinge, the hinge urging the cover through the first aperture into the first recess in the interior of the housing.

4. The bottle top cutting device of claim 1 further including a dual faced razor blade disposed in the second recess.

5. The bottle top cutting device of claim 1 further comprising a third recess in communication with the second recess, the third recess configured to receive a receptacle.

6. The bottle top cutting device of claim 4 further comprising a receptacle slidably seated in the third recess.

* * * * *